US007760993B2

(12) United States Patent
You

(10) Patent No.: US 7,760,993 B2
(45) Date of Patent: Jul. 20, 2010

(54) METHOD AND DEVICE FOR FORMING STEAM FOR HOUSEHOLD APPLIANCE

(76) Inventor: Tuming You, 265 Jia He Road, No. 2102, Xiamen (CN)

( * ) Notice: Subject to any disclaimer, the term of this patent is extended or adjusted under 35 U.S.C. 154(b) by 644 days.

(21) Appl. No.: 11/651,903

(22) Filed: Jan. 9, 2007

(65) Prior Publication Data

US 2008/0115740 A1 May 22, 2008

(51) Int. Cl.
*F24H 1/10* (2006.01)

(52) U.S. Cl. ..... 392/494; 392/465; 392/324

(58) Field of Classification Search ..... None
See application file for complete search history.

(56) References Cited

U.S. PATENT DOCUMENTS

| | | | | | |
|---|---|---|---|---|---|
| 941,215 | A * | 11/1909 | Wade | 392/494 |
| 3,782,456 | A * | 1/1974 | Gusmer | 165/164 |
| 3,891,827 | A * | 6/1975 | Wyse | 392/477 |
| 4,343,988 | A * | 8/1982 | Roller et al. | 392/467 |
| 4,508,957 | A * | 4/1985 | Rocchitelli | 392/479 |
| 5,265,318 | A * | 11/1993 | Shero | 29/447 |
| 6,243,535 | B1 * | 6/2001 | Bochud | 392/459 |
| 6,330,395 | B1 * | 12/2001 | Wu | 392/494 |
| 6,816,670 | B1 * | 11/2004 | Renau | 392/467 |
| 6,889,005 | B2 * | 5/2005 | Amberg | 392/484 |
| 7,190,893 | B2 * | 3/2007 | Kuebler et al. | 392/485 |
| 2005/0019028 | A1 * | 1/2005 | Kuebler et al. | 392/484 |
| 2008/0001000 | A1 | 1/2008 | You | |
| 2008/0040954 | A1 * | 2/2008 | Yu et al. | 38/85 |
| 2008/0047172 | A1 | 2/2008 | You | |

OTHER PUBLICATIONS

U.S. Appl. No. 11/703,044, filed Feb. 5, 2007, Tuming You.
U.S. Appl. No. 11/938,731, filed Nov. 12, 2007, Tuming You.

* cited by examiner

*Primary Examiner*—Thor S Campbell
(74) *Attorney, Agent, or Firm*—Squire Sanders & Dempsey LLP

(57) ABSTRACT

The device and the method for forming steam are used for household appliance. Principle: water enters into the heated spiral tube chamber through the inner end of the spiral tube chamber; water contacts the side wall of the spiral tube chamber, and is vaporized, then diffused along the spiral tube chamber; part of the water droplets diffuses with vapor, and contacts the side wall of the spiral tube chamber gradually, then is vaporized; vapor is obtained from the outer end of the spiral tube chamber. In one word, the invention provides a method to obtain "dry" steam which doesn't contain water. It is more efficient than other facilities.

7 Claims, 7 Drawing Sheets

METHOD AND DEVICE FOR FORMING STEAM FOR HOUSEHOLD APPLIANCE

CROSS-REFERENCE TO RELATED APPLICATIONS

This application claims priority to Chinese Patent Application No. 200610135235.7, filed on Nov. 20, 2006, the teachings of which are incorporated hereto by reference in their entirety.

FIELD OF THE INVENTION

The present invention relates to the technology field of forming steam, and more particularly, to provide the method and the device for forming steam for household appliance.

BACKGROUND OF THE INVENTION

Some household appliances, for example, the electric iron, steam cleaner, steam vacuum, hair curling machine and microwave oven etc, usually contain a device relative to forming steam. Taking the electric iron for instance, steam given out from soleplate causes the ironed cloth to be humidified uniformly. The process is as below: Controlled by the valve, water is dropped into the forming steam chamber which is formed on the top of soleplate. When heating soleplate, water collides with the bottom of heated forming steam chamber, and is vaporized immediately, then steam bursts from the holes positioned on the bottom of soleplate. The other facility of forming steam used for the present household appliance is similar to that.

The method mentioned above has a drawback that water cannot be vaporized immediately, water droplets which are not vaporized are guided by formed steam, then burst with formed steam from the holes, so that the steam mixes with a lot of water droplets. It can not reach anticipated efficiency.

SUMMARY OF THE INVENTION

The present invention is to provide the device and the method for forming steam used for household appliance. The major advantage of the invention is to overcome the drawback of the existing device and method that steam comes out mixed with a lot of water droplets.

The present invention provides the following technology:

The method for forming steam, including: 1) causing water to drop into spiral tube chamber through the inner of heated spiral tube chamber; 2) causing water to collide with the side wall of the spiral tube chamber, and is vaporized, then diffuse along the spiral tube chamber; 3) allowing the part of water droplets to diffuse with steam and contact with the side wall of the spiral tube chamber to vaporize; and 4) obtaining steam at the outer end of the spiral tube chamber.

The device for forming steam used for household appliance, comprising: a spiral tube chamber, a facility for heating set on the outside of spiral tube chamber, a water intake on the inner end of the spiral tube chamber, and a steam outlet on the outer end of the spiral tube chamber.

The device for forming steam used for household appliance mentioned above, wherein the spiral tube chamber is on the heating unit, wherein the electric heating element, which is buried in the body of the heating unit, constitutes the device.

The structure of heating unit can have two designs as described below:

1) The heating unit includes the main body of the heating unit and the cover plate which is fixed on the top of the main body of the heating unit, two spiral grooves, which are respectively machined in the opposite surface of the main body of the heating unit and the cover plate, constitute the spiral groove. The electric heating element is buried in the main body of the heating unit, the water intake is formed on the upper surface of the cover plate facing to the inner end of the spiral groove, the steam outlet is formed on the upper surface of the cover plate facing to the outer end of the spiral groove.

The cross section of said spiral tube chamber can be circular.

The sealing washer is provided between the main body of the heating unit and the cover plate.

2) the heating unit includes the main body of the heating unit, the upper cover plate which is fixed on the top of the main body of the heating unit and the lower cover plate which is fixed on the bottom of the main body of the heating unit; the first spiral groove, which is machined on the upper surface of the main body of the heating unit, constitutes the first spiral chamber with the lower surface of the upper cover plate; the second spiral groove, which is machined on the lower surface of the main body of the heating unit, constitutes the second spiral chamber with the upper surface of the lower cover plate; the electric heating element is buried in the main body of the heating unit; the inner end of the first spiral tube chamber and the second spiral tube chamber connected with each other, the water intake is formed on the top of upper cover plate facing to the inner end of spiral tube chamber, the steam outlet is formed on the side wall of the main body of the heating unit facing to the outer end of the two spiral grooves.

The cross section of the first spiral tube chamber and the second spiral tube chamber are both rectangles.

The sealing washers are respectively provided between the heating unit and the upper cover plate, the lower cover plate.

In the device for forming steam used for household appliance, the spiral tube chamber is set on the soleplate of the iron, the electric heating element, which is buried in the soleplate, constitutes the heating facility; the spiral groove which is formed on the upper surface of soleplate, the cover plate which is fixed on the top of the spiral groove, constitute a spiral tube chamber; the water intake which is formed on the upper end of the spiral tube chamber, the steam outlet which is formed on the lower end of the spiral tube chamber.

It is known from the description for the structure of the present invention, compared with the present technology, that the advantages of the present invention can be as follows: 1) water droplets that can't be vaporized are guided by formed steam, then diffuse along spiral tube chamber with steam, continually collide with the side wall of the spiral tube chamber acted by centrifugal force, then are vaporized, so that the steam burst from steam outlet does not contain water droplets; 2) steam is continually heated in spiral tube chamber, therefore allowing one to obtain steam that has the required temperature; 3) it is a simple and reasonable structure, which is easy to be manufactured.

DESCRIPTION OF SPECIFIC EMBODIMENTS

Figure 1:
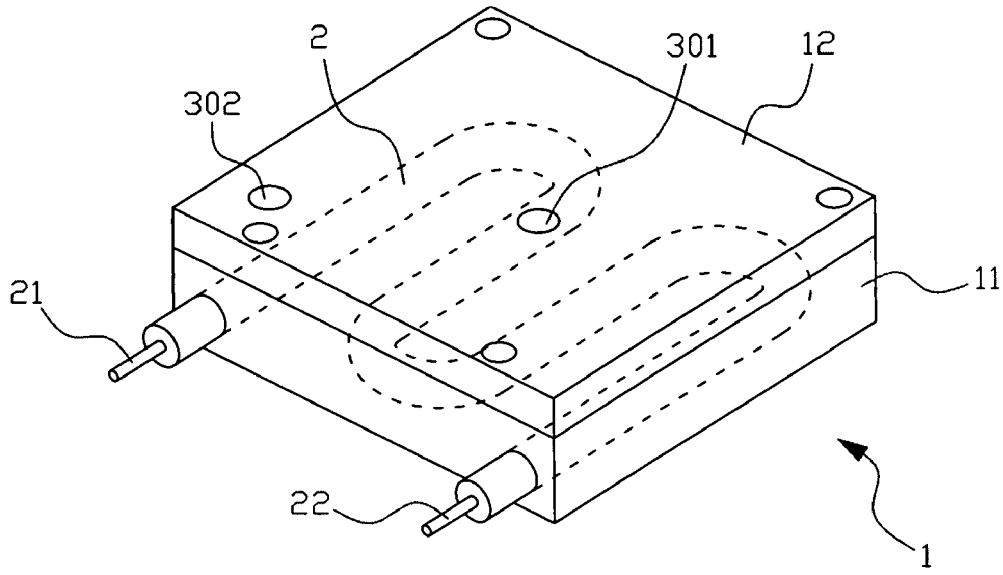
FIG. 1 is a stereogram of the first embodiment of the present invention.

The first embodiment of the present invention model, referring to FIG. 1, is explained as follow: the device for forming steam contains a heating unit 1, which is comprised of the main body of heating unit 11 and the cover plate 12 which is located on the top of the main body of the heating unit 11, they are fixed by screws. The electric heating element 2 is buried in the main body of heating Unit 11, and two power connectors 21, 22 connected with the end of electric heating element 2, so the electric heating element is a heating facility for the heating unit.

Figure 2:
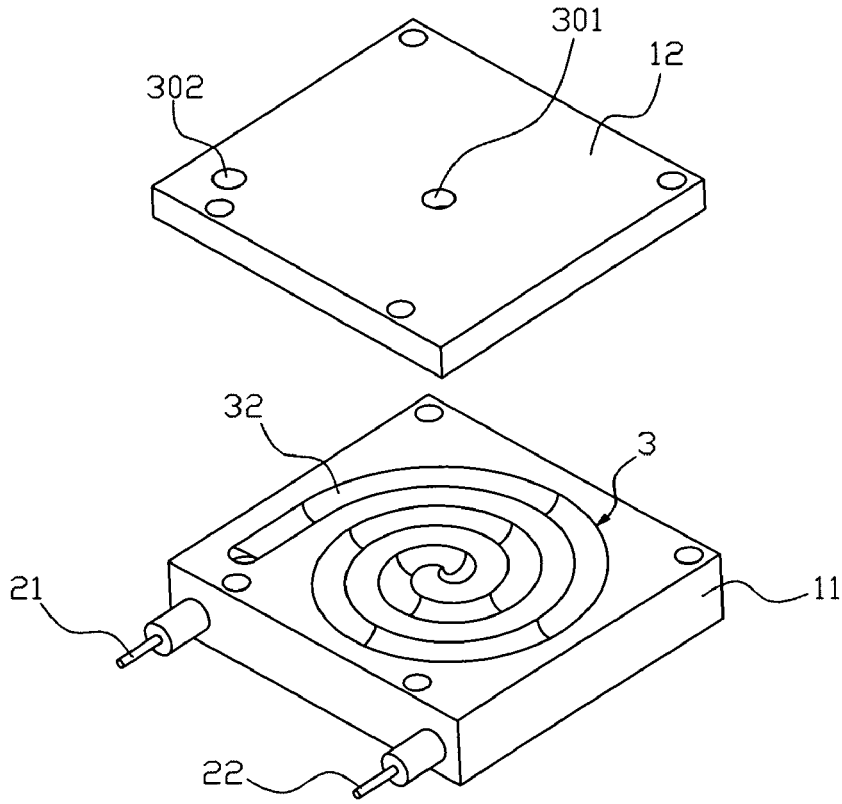
FIG. 2 is the exploded view of the first embodiment of the present invention.
Figure 3:
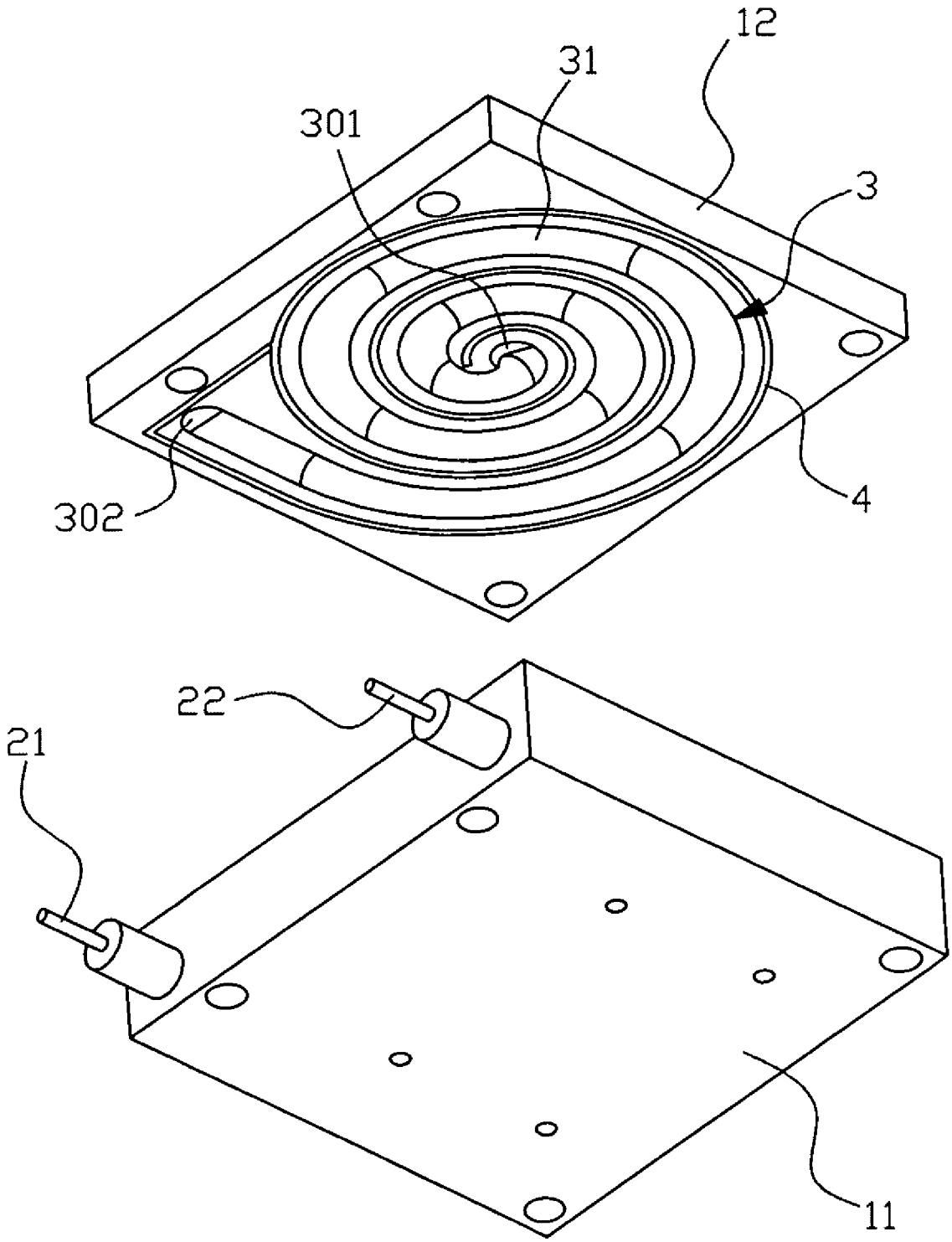
FIG. 3 is the exploded view from other angle of the first embodiment of the present invention.

Referring to both FIG. 2 and FIG. 3, when the main body of heating unit 11 and the cover plate 12 are fixed with regard to each other, two spiral grooves 32, 32' (not shown in the figures), which are respectively set on the opposite surface of the main body 11 and cover plate 12, constitute whole spiral tube chamber 3. Water can enter into the spiral tube chamber 3 through water intake 301 which is positioned on the top of cover plate 12 facing to the inner end of spiral groove 31. The vapor formed in the spiral tube chamber 3 can burst through steam outlet 302 which is positioned on the top of cover plate 12 facing to the outer end of the spiral groove 31.

Referring to FIG. 3, the sealing washer 4 is provided between the main body of heating unit 11 and the cover plate 12 to prevent water or vapor leaking.

In this embodiment, the cross section of spiral tube chamber 3 is a circle. Certainly it does not limit the shape and it is easy to be designed to different shapes, for example, a square, a rectangle, and a rhombus, etc. The central axis of the spiral tube chamber 3 is uniform speed spiral; of course, it does not limit the above shapes, it can be designed to other types of regular spiral or irregular spiral, the spiral here is a generalized spiral which means all kinds of spiral can be used. The inner end of the spiral rube chamber 3 is located not only on the center of the spiral but also on any position of the spiral in which is nearer to the center of the spiral than to the outer end of the spiral.

When water enters spiral tube chamber 3 through intake 301, and cannot be vaporized completely. Water droplets which can't be vaporized are guided by formed steam, diffuse along the spiral tube chamber 3 with vapor, and collide to the side wall of the spiral tube chamber 3 acted by centrifugal force, then are continually vaporized, so that the steam burst from steam outlet does not contain water droplets; moreover, steam is continually heated in the spiral tube chamber 3, it ensures that steam bursting from steam outlet 302 has the required temperature; on the other hand, the spiral tube chamber 3 is formed by the main body of the heating unit 11 and cover plate 12, it is easy to make mold, the structure of the embodiment is simple, reasonable and is easy to be manufactured.

Figure 4:
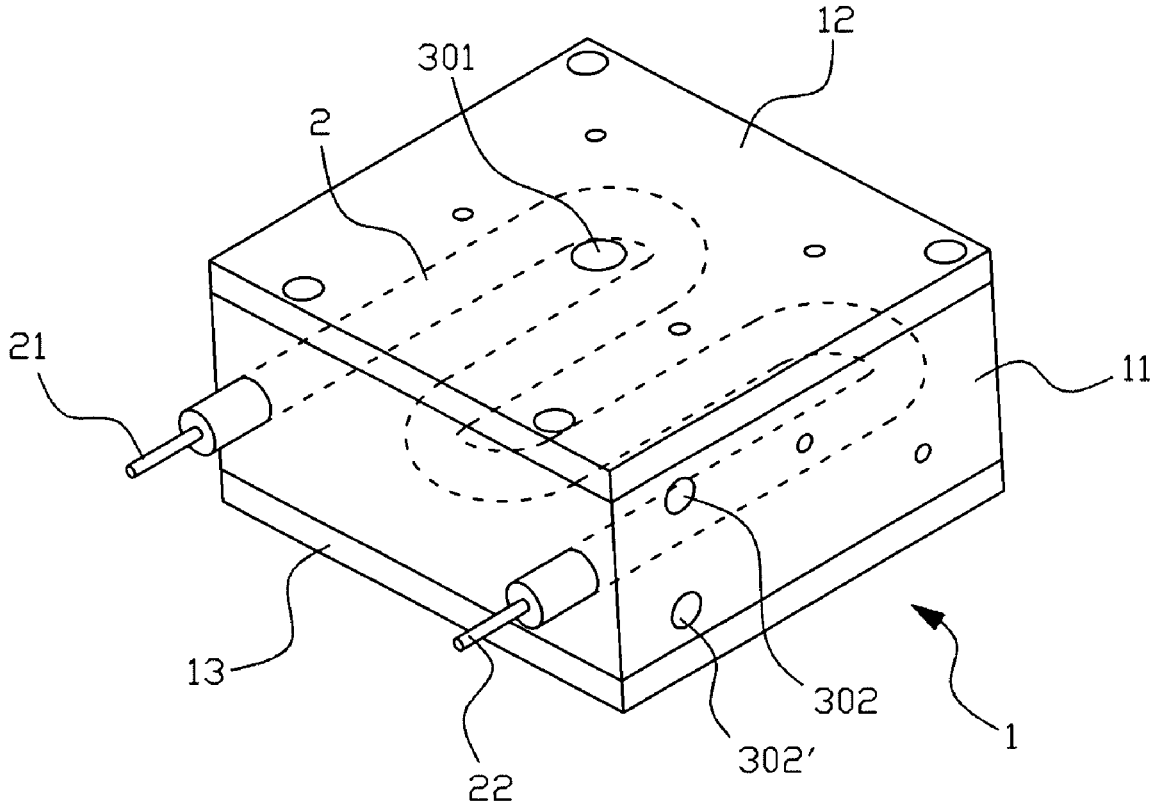
FIG. 4 is a stereogram of the second embodiment of the present invention.

The second embodiment of the present invention, referring to FIG. 4, comprising: the heating unit 1 that contain the main body of the heating unit 11, the upper cover plate 12 that is set on the top of the main body of the heating unit and lower cover plate 13 that is set on the bottom of the main body of the heating unit, they are fixed by screws. The electric heating element 2, which is buried in the main body of the heating unit, constitutes the facility for heating. Two power connectors. 21, 22, which are set outside of the main body of the heating unit 11, are connected with the heating element 2.

Figure 5:
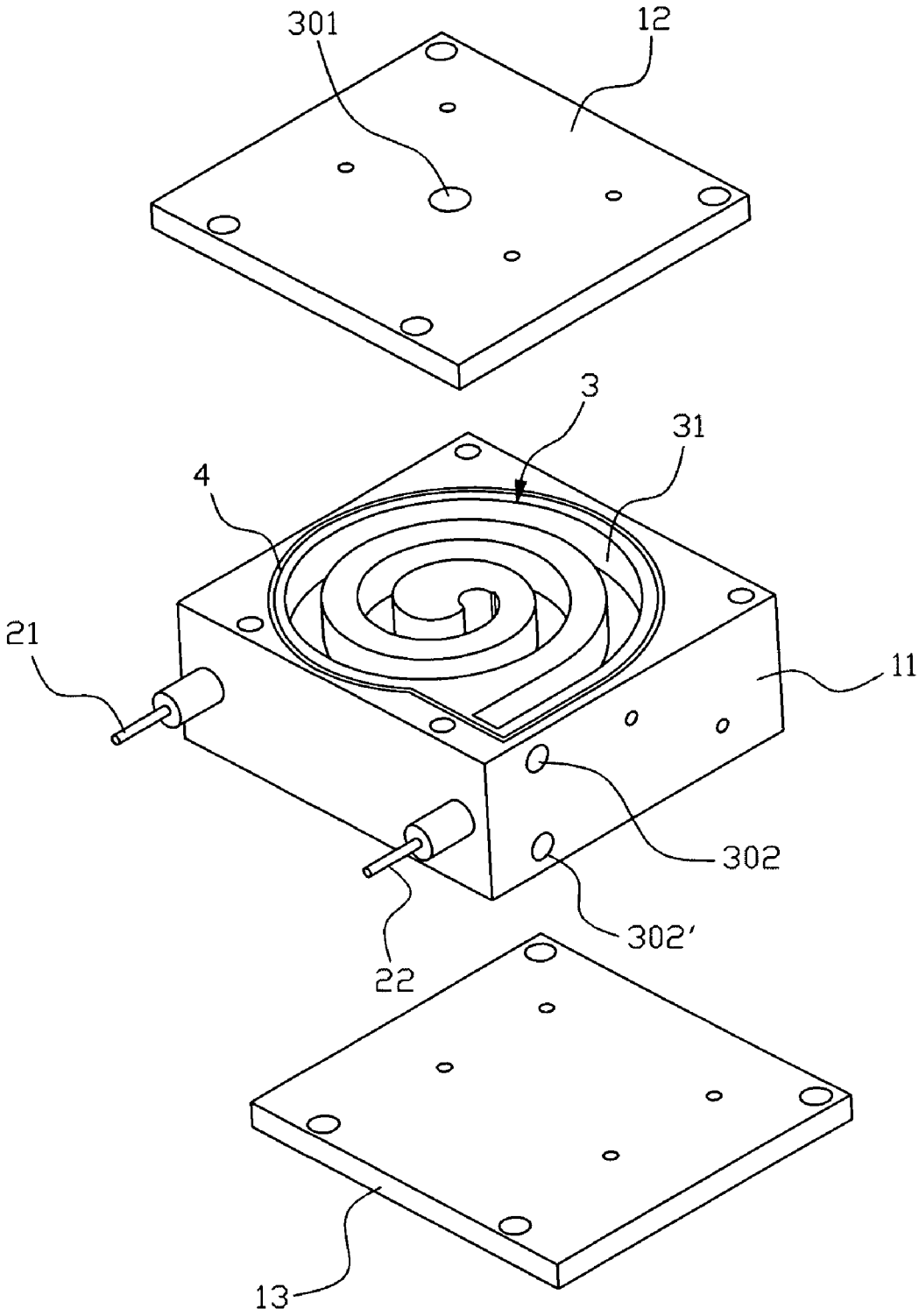
FIG. 5 is the exploded view of the second embodiment of the present invention.
Figure 6:
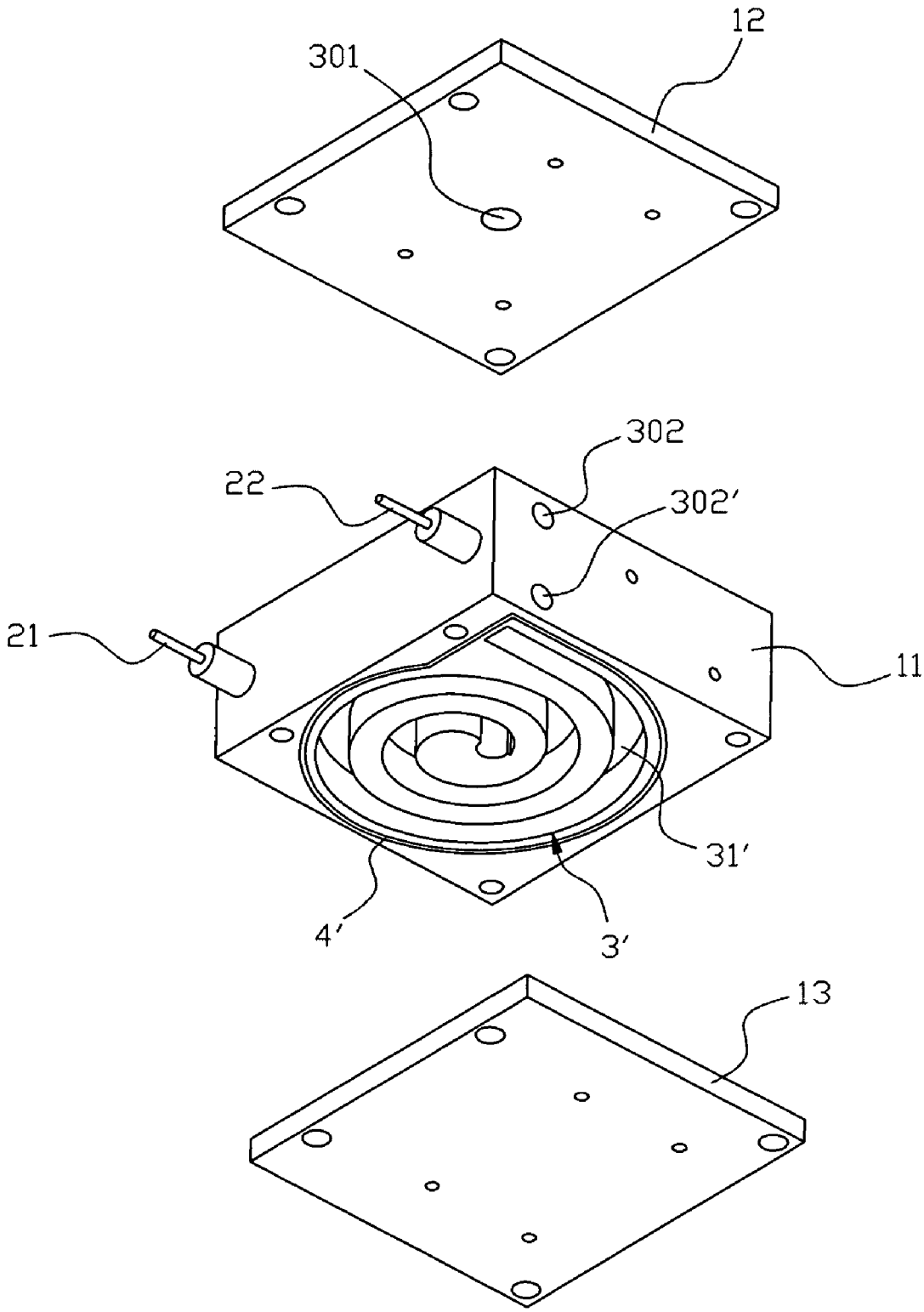
FIG. 6 is the exploded view from other angle of the second embodiment of the present invention.
Figure 7:
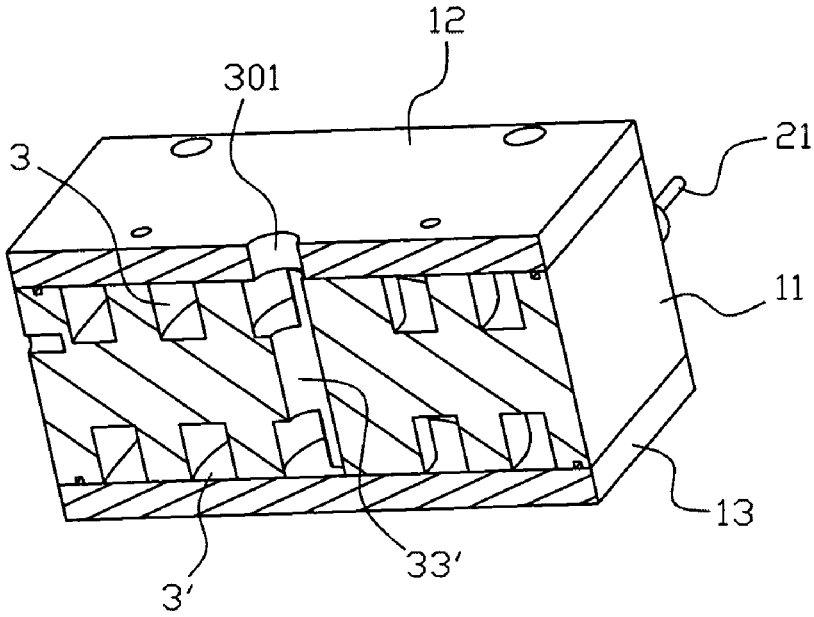
FIG. 7 is the cross sectional view of the second embodiment of the present invention.
Figure 8:
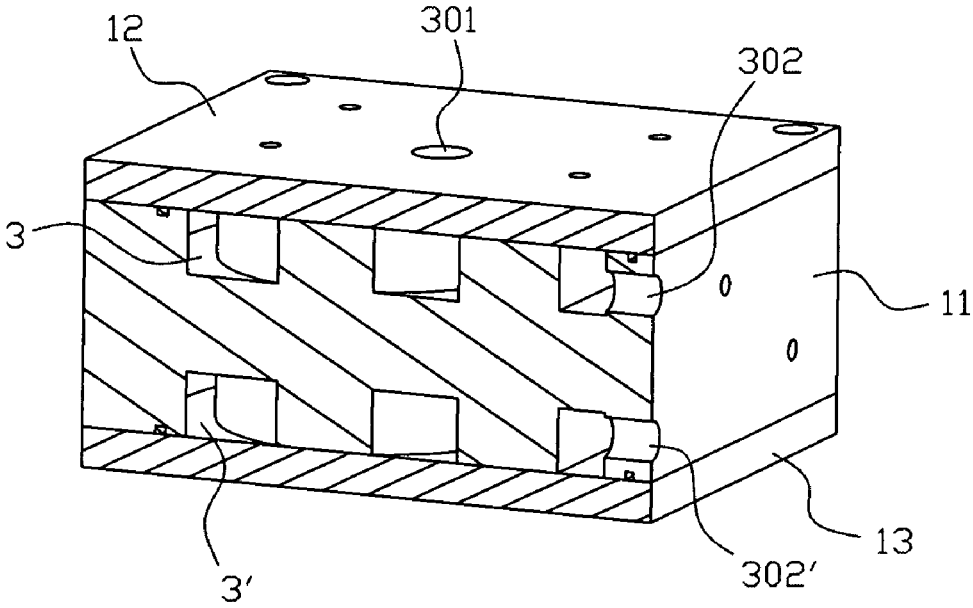
FIG. 8 is other cross sectional view of the second embodiment of the present invention.

Referring to FIG. 5, the spiral groove 31, which is machined on the top of the main body of the heating unit 11, forms the first spiral tube chamber 3 enclosed with the lower surface of upper cover plate 12. Referring to FIG. 6, the spiral groove 31', which is machined on the bottom of the main body of the heating unit 11, is turned to the second spiral tube chamber 3' with the upper surface of the lower cover plate 13. Referring to FIG. 7, the inner end of the first spiral tube chamber 3 connects to the inner of the second spiral tube chamber 3' by through hole 33', and the water intake 301 is set on the top of upper cover plate 12 facing to the spiral tube chamber 3, 3'. Water can enter the spiral tube chambers 3, 3' through the water intake 301. Referring to FIG. 8, two steam outlets 302, 302' are set on the side wall of the main body of the heating unit 11 facing to two spiral tube chambers 3, 3' separately.

Referring to FIG. 5 and FIG. 6, two sealing washers 4, 4' are provided between the main body of the heating unit 11 and the upper cover plate 12, the lower cover plate 13 respectively to prevent water or vapor leaking. In the present embodiment, the cross section of the first spiral tube chamber 3 and the second tube chamber 3' is a rectangle.

The working principle of the present embodiments is basically the same as the first embodiment, and the major difference is that two spiral tube chambers are machined on both the upper surface and lower surface of the main body of the heating unit 11 in which the electric heating element is buried so that it is efficient for absorbing heat created by electric heating element 2.

The embodiment mentioned above can be used for steam vacuum and steam cleaner, etc.

Figure 9:
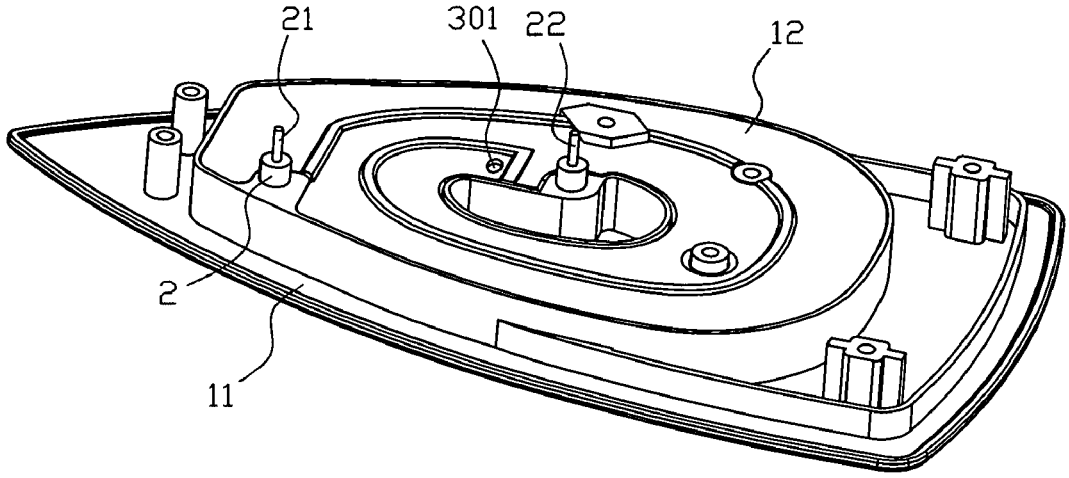
FIG. 9 is the stereogram of the third embodiment of the present invention.

The third embodiment of the present invention, referring to FIG. 9, is used for soleplate of iron. The heating element 2, which is buried in the inner of soleplate 11, constitutes the facility for heating soleplate 11. Two power connectors 21, 22, which are set outside of soleplate 11, are connected with the heating element 2.

Figure 10:
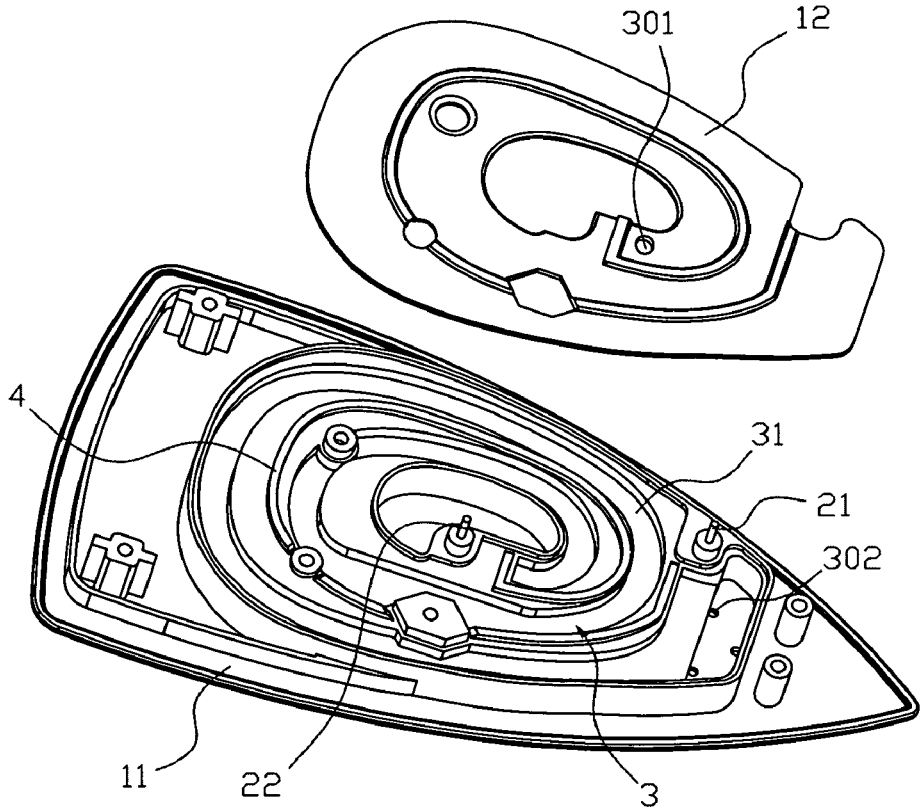
FIG. 10 is the exploded view of the third embodiment of the present invention.

Referring to FIG. 10, the spiral groove 31, which is formed on top of soleplate 11, is turned into the spiral tube chamber 3 enclosed with the cover plate 12 which is fixed on the top of spiral groove 31. The water intake 301 is formed on the cover plate 12 facing to the inner end of the spiral tube chamber 3. The vapor outlet is formed on the bottom of soleplate 11 facing to outer end of the spiral tube chamber 3.

The configuration and working principle of the present embodiment are similar to the first embodiment. The major difference is that the shape of the spiral tube chamber 3 is adjusted to fit the shape of soleplate due to the embodiment used in iron, the outer shape resembling an ellipse. Water drops from water tank to the spiral tube chamber through inlet 301, the water tank is positioned on the top of soleplate 11. Steam formed in the spiral tube chamber 3 can burst from steam outlet 302 which is set on the bottom of soleplate 1.

The sealing washer is provided between the cover plate 12 and the soleplate 11 to prevent water or vapor leaking.

Summarizing three embodiments mentioned above, the method of the present invention for forming steam includes:

1) causing water to enter into the spiral tube chamber through the inner end of the heated spiral tube chamber; 2) causing water to contact the side wall of the spiral tube chamber and is vaporized and then diffused along the spiral tube chamber; 3) causing water droplets, which may form in the process of vaporization, to diffuse with vapor and contact the side wall of the spiral tube chamber gradually to vaporize; and 4) causing vapor to burst from the outer end of the spiral tube chamber. The function of the spiral tube chamber is to separate water from steam and to further vaporize separated water since the steam and water move at difference speeds in the spiral tube chamber, and it improves fuel efficiency.

As mentioned above, there are several embodiments; and they do not limit the scope of the present invention. For example, a mini water pump can be set on the outside of water intake to increase the water pressure. The equivalent changes and modifications based on the contents of the present invention, belong to the scope of the present invention.

I claim:

1. A device for forming steam for household appliance, comprising:

a spiral tube chamber, a heating unit comprising a heating element which is set on the outside of spiral tube chamber, a water intake which is on the inner end of the spiral tube chamber, and a steam outlet which is at the outer end of the spiral tube chamber, wherein the spiral tube chamber is on the heating unit, wherein the heating element is an electric heating element, which is buried in the body of the heating unit, and constitutes the heating facility, and wherein the heating unit comprises:

a main body, a cover plate set on the top of the main body of the heating unit, two spiral grooves, which are respectively set on the opposite face of the cover plate and the main body of the heating unit, forming the spiral tube chamber, the electric heating element being buried in the main body of the heating unit, a water intake on the upper surface of the cover plate facing the inner end of the spiral groove, and a steam outlet on the upper surface of the cover plate facing to the outer end of the spiral groove.

2. A device for forming steam for household appliance, comprising:

a spiral tube chamber, a heating unit comprising a heating element which is set on the outside of spiral tube chamber, a water intake which is on the inner end of the spiral tube chamber, and a steam outlet which is at the outer end of the spiral tube chamber, wherein the spiral tube chamber is on the heating unit, wherein the heating element is an electric heating element, which is buried in the body of the heating unit, and constitutes the heating facility, and wherein the heating unit comprises:

a main body;

a upper cover plate which is located on the top of the main body of the heating unit;

a lower cover plate which is located on the bottom of the main body of the heating unit;

a first spiral groove, which is machined on top of the main body of the heating unit, constituting the first spiral tube chamber enclosed within the lower surface of the upper cover plate;

a second spiral groove, which is machined on the bottom of the main body of the heating unit, constituting the second spiral tube chamber enclosed with the upper surface of the lower cover plate;

a heating element buried in the main body of the heating unit;

two inner ends of the first spiral tube chamber and the second spiral tube chamber connecting with each other;

a water intake on the top of the upper cover plate facing the inner end of the spiral tube chamber; and a steam outlet on the side wall of the main body of the heating unit facing the outer end of two spiral grooves.

3. The device for forming steam for household appliance of claim 1, wherein a sealing washer is provided between the main body of the heating unit and the cover plate.

4. The device for forming steam for household appliance of claim 2, wherein the spiral tube chamber is formed on a soleplate of iron, wherein the electric heating element is buried in the soleplate and constitutes the heating facility;

wherein the spiral groove is formed on the upper surface of the soleplate and constitutes the spiral tube chamber enclosed within the cover plate which is located on the top of the spiral groove;

wherein the water intake is formed on the upper surface of the cover plate facing the inner end of the spiral tube chamber; and wherein the steam outlet is formed on the lower surface of the soleplate facing the outer end of the spiral tube chamber.

5. The device for forming steam for household appliance of claim 2, wherein the cross section of the spiral tube chamber is circular.

6. The device for forming steam for household appliance of claim 2, wherein the cross sections of the first spiral tube chamber and the second spiral tube chamber are rectangular.

7. The device for forming steam for household appliance of claim 2, wherein sealing washers are provided between the upper cover plate, the lower cover plate and the main body of the heating unit separately.

* * * * *